US008340342B2

(12) United States Patent
Jin et al.

(10) Patent No.: US 8,340,342 B2
(45) **Date of Patent: *Dec. 25, 2012**

(54) DIAPHRAGM FOR SPEAKER, SPEAKER USING THE DIAPHRAGM, ELECTRONIC DEVICE USING THE SPEAKER, AND SPEAKER-MOUNTED DEVICE

(75) Inventors: Yohei Jin, Mie (JP); Yoshimichi Kajihara, Osaka (JP); Shinya Mizone, Mie (JP); Kazuaki Nishimura, Mie (JP)

(73) Assignee: Panasonic Corporation, Osaka (JP)

( * ) Notice: Subject to any disclaimer, the term of this patent is extended or adjusted under 35 U.S.C. 154(b) by 102 days.

This patent is subject to a terminal disclaimer.

(21) Appl. No.: 12/812,313

(22) PCT Filed: Jan. 7, 2009

(86) PCT No.: PCT/JP2009/000022

§ 371 (c)(1),
(2), (4) Date: Jul. 9, 2010

(87) PCT Pub. No.: WO2009/090857

PCT Pub. Date: Jul. 23, 2009

(65) Prior Publication Data

US 2011/0164764 A1 Jul. 7, 2011

(30) Foreign Application Priority Data

Jan. 18, 2008 (JP) ..... 2008-008864

(51) Int. Cl.
*H04R 11/02* (2006.01)

(52) U.S. Cl. ..... 381/428; 181/169; 523/223

(58) Field of Classification Search ..... 381/428, 381/396, 398, 421; 181/169, 170, 168, 167; 523/223

See application file for complete search history.

(56) References Cited

U.S. PATENT DOCUMENTS

| | | | | |
|---|---|---|---|---|
| 2007/0131478 | A1 | 6/2007 | Okazaki et al. | |
| 2008/0027158 | A1 * | 1/2008 | Ishida et al. | 523/223 |
| 2009/0080687 | A1 * | 3/2009 | Mimura et al. | 381/428 |

FOREIGN PATENT DOCUMENTS

| | | | |
|---|---|---|---|
| CN | 1388727 | A | 1/2003 |
| EP | 1612020 | A2 | 1/2006 |
| JP | 03-056287 | U | 5/1991 |
| JP | 2002-354594 | | 12/2002 |
| JP | 2003-204588 | A | 7/2003 |
| JP | 2005-75836 | A | 3/2005 |
| JP | 2006-016461 | A | 1/2006 |
| JP | 2007-221635 | A | 8/2007 |
| WO | 2005/079110 | A1 | 8/2005 |

OTHER PUBLICATIONS

International Search Report for Application No. PCT/JP2009/000022, Mar. 10, 2009, Panasonic Corporation.
JP Office Action for 2008-008864, Feb. 28, 2012.

* cited by examiner

*Primary Examiner* — Curtis Kuntz
*Assistant Examiner* — Amir Etesam
(74) *Attorney, Agent, or Firm* — RatnerPrestia

(57) ABSTRACT

A speaker diaphragm containing resin and carbonized bamboo material with a large degree of flexibility in setting physical properties, moisture-proof reliability and strength secured, superior appearance, and productivity and dimensional stability increased, which allows making characteristics and sound highly accurately, and designing with great originality.

18 Claims, 3 Drawing Sheets

DIAPHRAGM FOR SPEAKER, SPEAKER USING THE DIAPHRAGM, ELECTRONIC DEVICE USING THE SPEAKER, AND SPEAKER-MOUNTED DEVICE

This application is a U.S. National Phase Application of PCT International Application PCT/JP2009/000022.

TECHNICAL FIELD

The present invention relates to a diaphragm for a speaker used for various types of audio and video devices, to a speaker using the diaphragm, to an electronic such as a stereo set and TV set, and to a speaker-mounted device such as an automobile.

BACKGROUND ART

A conventional diaphragm for a speaker is known such as in patent literatures 1 and 2. A description is made of a conventional speaker diaphragm using FIG. 6. FIG. 6 is a sectional view of a speaker diaphragm made of resin by conventional injection molding.

As shown in FIG. 6, conventional speaker diaphragm 31 is produced by heat-dissolving resin pellets (e.g. polypropylene) and injection molding into a preliminarily shaped mold.

A typical example of a resin material for injection molding is a single material such as polypropylene. Besides, in order to adjust physical properties as a speaker diaphragm (i.e. to adjust speaker characteristics and sound quality), a blended material (different resins are used) is used.

Further, to adjust other physical properties difficult to adjust by the resins, a reinforcing material such as mica is mixed to adjust speaker characteristics and sound quality. To further increase the degree of flexibility in adjusting physical properties, a pulp material is mixed for sound quality adjustment.

As to the latest audio and video devices and speaker-mounted device (e.g. an automobile) with these electronic devices on board, their performance has been dramatically improved as compared to conventional ones owing to the significant progress of digital technologies.

As to sound quality, reality has been increased by lower distortion, a wider bandwidth, and a higher dynamic range. As to image quality, its performance has been remarkably improved by finer resolution and the advent and proliferation of large-size modules (e.g. plasma display panel).

Accordingly, with the performance improvement of the above electronic devices, the market strongly demands performance improvement from speakers used for the electronic devices as well.

Hence, a speaker in such a situation essentially requires higher performance of the speaker diaphragm, a major factor in determining sound quality among the speaker components. Speaker diaphragms, however, are typically made of paper or resin because they are produced by traditional papermaking, or injection molding or press working of resin.

Under the circumstances, these speaker diaphragms have been used according to their uses while taking advantage of each feature. However, they have their respective disadvantages and do not satisfy the above-described market request.

Specifically, with a paper diaphragm, physical properties of the speaker diaphragm can be set minutely, which allows increasing the degree of flexibility in adjusting characteristics as a speaker and sound quality. The diaphragm, however, has low moisture-proof reliability and strength, which are disadvantages specific to paper. Further, producing the diaphragm requires papermaking, namely a large number of production steps.

A resin diaphragm, meanwhile, secures moisture-proof reliability and strength; has a good appearance; and increases productivity. The diaphragm, however, can secure only uniform physical properties specific to resin, which is inevitable. Hence, the diaphragm is disadvantageous in its extremely small range of adjusting characteristics as a speaker and sound quality.

A speaker diaphragm produced by mixing resin and pulp material has a large degree of flexibility in adjusting sound quality and secures moisture-proof reliability. To improve physical properties and sound quality, however, the strength of the speaker diaphragm needs to be increased.

[Patent literature 1] Japanese Utility Model Unexamined Publication No. H03-56287

[Patent literature 2] Japanese Patent Unexamined Publication No. 2003-204588

SUMMARY OF THE INVENTION

The present invention provides a speaker diaphragm that gives a large degree of flexibility in adjusting characteristics as a speaker and sound quality; secures moisture-proof reliability and strength; and improves productivity.

The present invention is configured to include resin and carbonized bamboo. The configuration does not largely reduce internal loss of resin as compared to other inorganic fillers and presents high rigidity of a carbonized bamboo material, efficiently in the resin. Keeping the resistance of resin to moisture and water increases the degree of flexibility in setting physical properties of the speaker diaphragm, and injection molding allows yielding speaker diaphragms with high productivity. Hence, the present invention gives a large degree of flexibility in adjusting characteristics as a speaker and sound quality; secures moisture-proof reliability and strength; and improves productivity.

REFERENCE MARKS IN THE DRAWINGS

Figure 1:
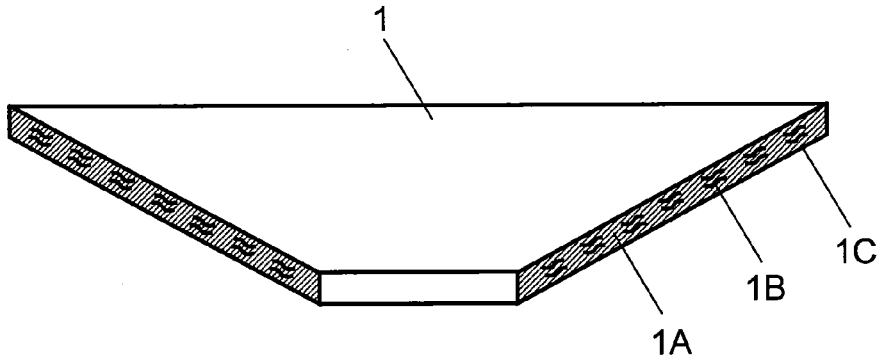
FIG. 1 is a sectional view of a speaker diaphragm according to the first exemplary embodiment of the present invention.

1 Speaker diaphragm
1A Resin
1B Carbonized bamboo material
1C Bamboo fiber
2 Magnet
3 Upper plate
4 Yoke
5 Magnetic circuit
6 Magnetic gap
7 Frame
8 Voice coil

9 Edge
10 Speaker
11 Enclosure
12 Amplifier
13 Player
14 Mini-component system
15 Automobile

DETAILED DESCRIPTION OF PREFERRED EMBODIMENTS

Hereinafter, a description is made of some embodiments of the present invention using the related drawings.

First Exemplary Embodiment

Figure 2:
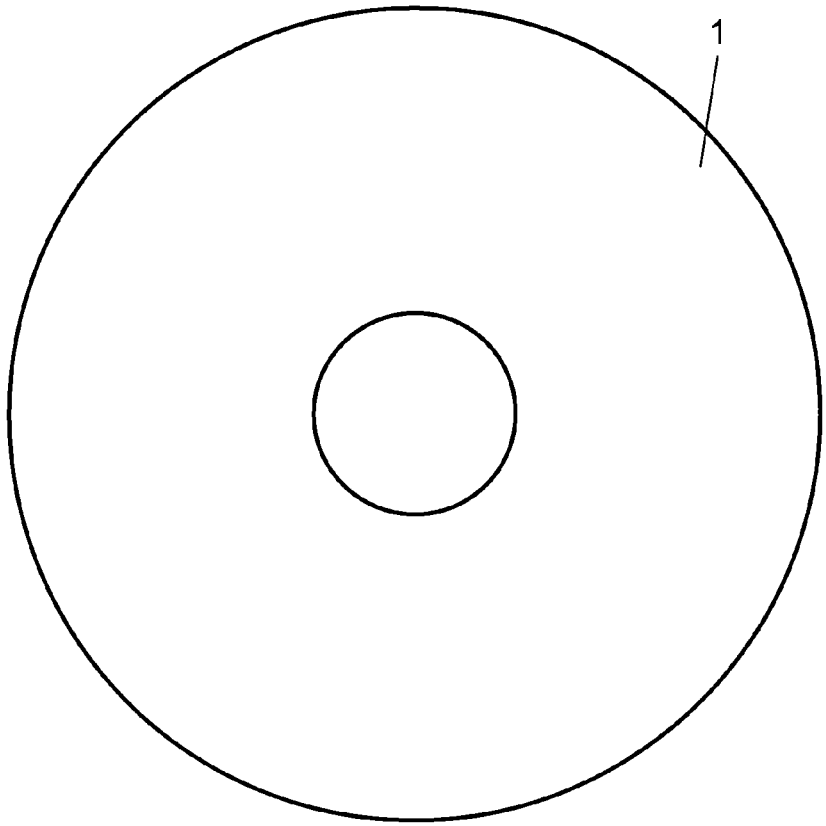
FIG. 2 is a plan view of the speaker diaphragm.

FIG. 1 is a sectional view of a speaker diaphragm according to the first exemplary embodiment of the present invention. FIG. 2 is a plan view of the speaker diaphragm. In FIGS. 1 and 2, speaker diaphragm 1 is made by injection-molding material produced by mixing resin 1A and bamboo material 1B carbonized at 500° C. or higher.

Resin 1A is preferably a crystalline or amorphous olefin resin. Olefin resin provides favorable formability. Using crystalline or amorphous olefin resin according to uses allows physical properties as resin material to be optimized.

Bamboo material 1B carbonized at 500° C. or higher provides higher hardness; develops fine pores; and improves internal loss as compared to that carbonized at a temperature lower than 500° C. Such a material reproduces natural, bright tones while suppressing dark, uniform tones specific to resin. Sound quality can be adjusted and improved by mixing bamboo fiber 1C that is combined with material miniaturized to a microfibril state at least partially. Dyeing speaker diaphragm 1 with carbon black causes its rigidity to be degraded. Using carbonized bamboo material 1B, however, increases the rigidity of speaker diaphragm 1 while dyeing.

Hereinafter, a description is made of an example where polypropylene is used for resin 1A. Polypropylene is usually easy to obtain and to injection-mold. However, the resin of the present invention is not limited to polypropylene, but may be engineering plastic or biodegradable plastic as represented by polylactic acid for environmental considerations.

Carbonized bamboo material B is desirably between 30 μm and 100 μm in particle diameter, and more desirably between 40 μm and 70 μm.

The reason is, carbonized bamboo material B with a particle diameter of 100 μm or smaller can suppress dispersion defect, thereby improving appearance grade and physical properties. A particle diameter larger than 100 μm, however, causes dispersion defect to impair practical appearance. Meanwhile, carbonized bamboo material B with a particle diameter of 30 μm or larger can easily provide reinforcement effect, thereby allowing carbonized bamboo material B to be used efficiently. A particle diameter smaller than 30 μm, however, deteriorates the efficiency of practical uses. Particle diameters smaller than 30 μm or larger than 100 μm deteriorate productivity and product grade.

A particle diameter between 30 μm and 40 μm does not present practical problems, but makes it difficult to use the advantage of carbonized bamboo material 1B efficiently. Meanwhile, a particle diameter between 70 μm and 100 μm does not present practical problems, but tends to cause dispersion defect to impair appearance. Hence, a particle diameter sufficiently satisfying both productivity and product quality is between 40 μm and 70 μm.

A mix ratio of carbonized bamboo material 1B lower than 5% by weight hardly shows the effect of bamboo material 1B. Meanwhile, a mix ratio higher than 20% by weight degrades productivity and formability due to embrittlement and a decrease of fluidity of the speaker diaphragm, thereby decreasing the degree of flexibility in shaping.

Bamboo fiber 1C is preferably between 0.2 mm and 3 mm in length. This bamboo fiber 1C is added as a filler material. Using bamboo fiber 1C with this length most efficiently improves strength while improving productivity and quality, when resin 1A is combined with carbonized bamboo material 1B.

The average fiber diameter of bamboo fiber 1C miniaturized to a microfibril state is desirably smaller than 10 μm. Generally, fiber with a higher aspect ratio (L/D i.e. the ratio of fiber length L to fiber diameter D) has a higher elasticity, and thus bamboo fiber 1C miniaturized to a microfibril state with a large aspect ratio produces high elasticity. Specifically, an average fiber diameter between 0 and 10 μm to fiber length L between 0.2 mm and 3 mm always produces a high elasticity.

Moreover, the partial presence of bamboo fiber 1C miniaturized to a microfibril state forms a structure in which minute bamboo fiber intertwines together. The structure allows effectively using the hardness of carbonized bamboo material 1B. Consequently, a high elasticity of speaker diaphragm 1 is produced more effectively.

To make the tone more natural and bright, part or all of the bamboo material including bamboo fiber 1C may be bamboo powder. Using bamboo powder allows more than 50% by weight of bamboo fiber 1C to be mixed into resin easily. Consequently, using bamboo powder allows containing over half of natural fiber, thereby reducing the environmental load in using resin.

Further, to reinforce speaker diaphragm 1, to put some accents on a sound, and to adjust sound quality with its sound pressure frequency characteristics having a peak, a reinforcing material may be mixed. Examples of such a reinforcing material include at least any of mica, talc, calcium carbonate, and clay. For instance, mixing mica into a reinforcing material increases elasticity. Talc, calcium carbonate, or clay increases internal loss.

Using carbonized bamboo material 1B allows adjusting the color of speaker diaphragm 1 without deteriorating the elasticity of speaker diaphragm 1.

Using a compatibilizer increases compatibility between nonpolar resin such as polypropylene and bamboo fiber, which allows representing features of bamboo fiber efficiently. Particularly, the compatibilizer is desirably hydrolyzable long-chain alkylsilane. This is because a long-chain alkyl group of the alkylsilane is structured like olefin resin such as polypropylene, providing high compatibility. Consequently, compatibility with bamboo fiber increases as well, improving the characteristics. The compatibilizer is not limited to the alkylsilane, but another agent may be used such as what is called modified polypropylene (modified by a silane coupling agent or maleic anhydride to be polarized).

Here, combining bamboo fiber, a reinforcing material, and a compatibilizer allows adjusting physical properties of speaker diaphragm 1 freely and highly accurately, thereby implementing given characteristics and sound quality. Such implementation requires deep expertise on making characteristics and sound, which is typically practiced by the following method.

Specifically, in making characteristics and sound of a speaker, changing parameters of its components allows characteristics and sound quality to be changed to some extent for given values. For instance, assumption is made that parameters of speaker components other than speaker diaphragm 1 are fixed. Examples of a variable parameter in speaker diaphragm 1 include area size, shape, weight, surface thickness, besides physical properties.

However, the area size, shape, weight, and surface thickness of speaker diaphragm 1 are nearly determined at the initial step of designing the speaker. In other words, the sound pressure frequency characteristics of a speaker and sound quality are almost determined by conditions other than physical properties of speaker diaphragm 1. In this case, unnecessary peaks and dips tend to occur in the sound pressure frequency characteristics, and distortion occurs in a specific frequency band. As to sound quality, the tone quality depends largely on the sound pressure frequency characteristics. These problems result from the area size, shape, weight, and surface thickness of speaker diaphragm 1, particularly depending on the vibration mode of speaker diaphragm 1 in many cases. To select a diaphragm material for reducing unnecessary peaks, dips, and distortion for favorable sound quality, the next procedure can be followed.

First, as materials that appear to satisfy sound pressure frequency characteristics, sound quality, and reliability grade required for the speaker, selection is made of resin 1A, carbonized bamboo material 1B, bamboo fiber 1C miniaturized to a microfibril state at least partially, and other mixed materials. In this case, resin 1A as a base material is selected focusing particularly on reliability such as heat-resistance grade, and selected so that tone quality specific to each resin 1A becomes close to given tone quality.

Next, selection is made of each material to eliminate unnecessary peaks and dips in sound pressure frequency characteristics. To cope with dips, selection is made of a resin material including a resonance at the frequency; with peaks, including internal loss. In selecting materials, consideration is made for factors such as the density, elasticity, internal loss, tone quality, and resonance frequency when molded into the shape of speaker diaphragm 1, each specific to resin 1A, carbonized bamboo material 1B, bamboo fiber 1C, and other mixed materials.

Next, the materials selected are kneaded to produce master batch pellets made by highly filling bamboo material 1B and bamboo fiber 1C carbonized for injection molding. Next, these master batch pellets are injection-molded to produce speaker diaphragm 1.

Next, physical properties of speaker diaphragm 1 thus produced are measured and evaluated. A speaker is produced experimentally using speaker diaphragm 1; characteristics and sound quality are measured actually; and the sound is listened for final evaluation. If desired characteristics and sound quality are not obtained, this trial production process is repeated. During the process, better material selection and mixing ratio are sought to gradually approach target characteristics and sound quality.

Repeating the above process enables finishing speaker diaphragm 1 satisfying desired characteristics and sound quality; or extremely close to them.

Meanwhile, polypropylene is easily obtainable generally and easily injection-molded; however, the present invention is not limited to the resin material, but other materials may be freely used according to desired characteristics. For instance, when high resistance to heat or to solvent is required, engineering plastic satisfying the condition can be used.

For environmental considerations, biodegradable plastic, particularly polylactic acid, can be used. Polylactic acid has a relatively better compatibility with bamboo fiber than polypropylene, and using such as tannin as a compatibilizer further increases compatibility.

As described hereinbefore, resin and carbonized bamboo material are mixed to make a speaker diaphragm in this embodiment. Consequently, carbonizing bamboo material provides higher rigidity while keeping high elasticity, which results in higher rigidity of speaker diaphragm 1 to improve sound quality.

Further, while keeping high internal loss and moisture- and water-proof reliability, the configuration increases the degree of flexibility in setting physical properties of speaker diaphragm 1.

Speaker diaphragm 1 described above is produced by injection molding increases productivity and dimensional stability.

Selecting these resins and a reinforcing material (i.e. mixed material) from a variety of materials and appropriately setting the mixing ratio allow adjusting characteristics and sound quality highly accurately, which conventionally has been impossible.

Further, as to the product grade such as color, carbonized bamboo material enables high-grade, black-based design. Consequently, speaker diaphragm 1 superior in appearance is obtained. Further, adding carbon black-based pigment decreases the rigidity of speaker diaphragm 1; however, adding carbonized bamboo material can increase the rigidity of speaker diaphragm 1 simultaneously with coloring. Further, the combination can be set in infinite variation, thereby satisfying desired requirements in making characteristics and sound, and designing.

Second Exemplary Embodiment

Figure 3:
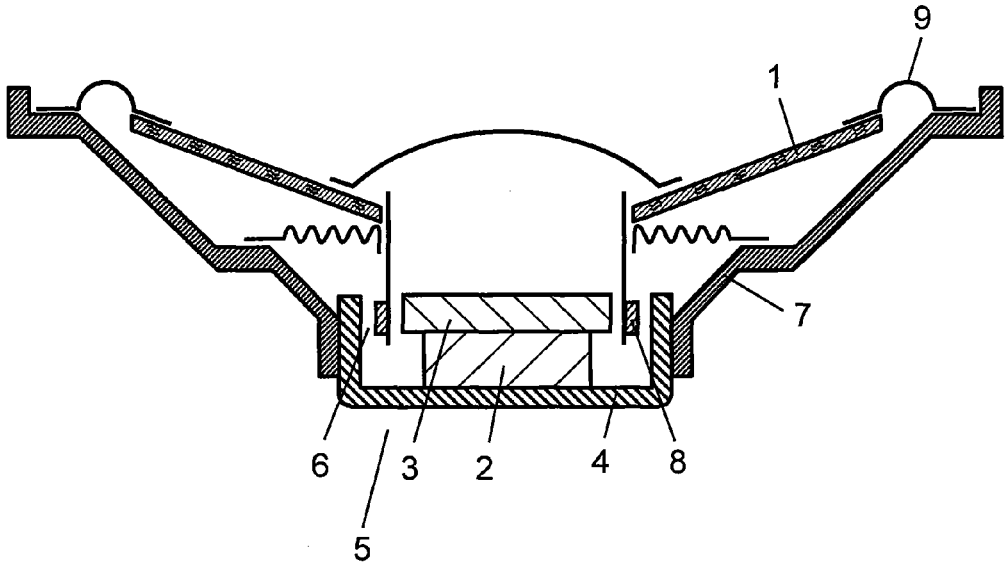
FIG. 3 is a sectional view of a speaker according to the second exemplary embodiment of the present invention.

FIG. 3 is a sectional view of a speaker according to the second exemplary embodiment of the present invention. As shown in FIG. 3, with the speaker of the embodiment, magnetized magnet 2 is sandwiched between upper plate 3 and yoke 4 to compose inner magnet type magnetic circuit 5. Yoke 4 of magnetic circuit 5 has frame 7 combined thereto. The circumference of frame 7 has the outer circumference of speaker diaphragm 1 described in the first embodiment bonded thereto through edge 9. One end of voice coil 8 is combined to the center of speaker diaphragm 1, and the opposite end is combined so as to fit into magnetic gap 6 of magnetic circuit 5.

In this embodiment, inputting a current of a sound signal to voice coil 8 causes a moment to be applied to voice coil 8, which vibrates speaker diaphragm 1 to generate sound.

In this embodiment, the description is made of a speaker having inner magnet type magnetic circuit 5; however, the present invention is not limited to such a speaker, but may be applied to a speaker having an external magnet type magnetic circuit.

As described in the first embodiment, this configuration implements a speaker with a high degree of flexibility in adjusting characteristics and sound quality, moisture-proof reliability and strength secured, superior appearance, and high productivity.

Third Exemplary Embodiment

Figure 4:
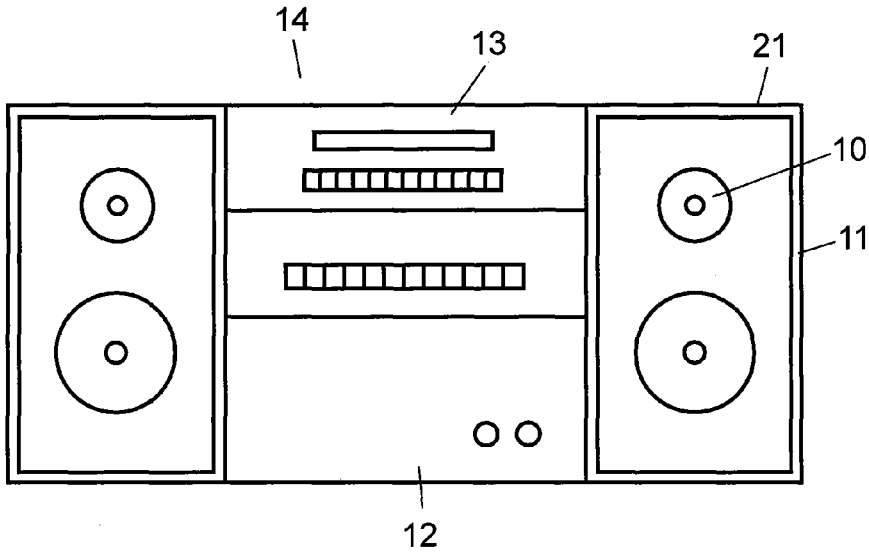
FIG. 4 is an external view of an electronic device according to the third exemplary embodiment of the present invention.

FIG. 4 is an external view of a mini-component system for audio as an electronic device according to the third embodiment of the present invention. Speaker 10 is incorporated into enclosure 11 to compose speaker system 21. Amplifier 12 has a circuit for amplifying electric signals input into speaker system 21. Operation unit 13 such as a player outputs a source input into amplifier 12. Audio mini-component system 14 as an electronic device thus includes amplifier 12, operation unit 13, and speaker system 21. Amplifier 12, operation unit 13, and enclosure 11 compose the main body of mini-component system 14. In other words, speaker 10 is attached to the main body of mini-component system 14. Speaker 10 has the speaker diaphragm described in the first embodiment attached thereto. Hence, the speaker described in the second embodiment can be used as speaker 10. The voice coil of speaker 10 is fed from amplifier 12 of the main body to produce sound from the speaker diaphragm.

As described in the first embodiment, mini-component system 14 of the above-described configuration allows making characteristics and sound highly accurately, which conventionally has been impossible, and designing with great originality.

As application of speaker 10 to an electronic device, the description is made of audio mini-component system 14; however, the present invention is not limited to the case, but is applicable to such as a portable audio device. Further, the invention is widely applicable to a video device (e.g. liquid crystal display TV and plasma display TV), an information communications device (e.g. mobile phone), and a computer-related device, and can broaden their product ranges.

Fourth Exemplary Embodiment

Figure 5:
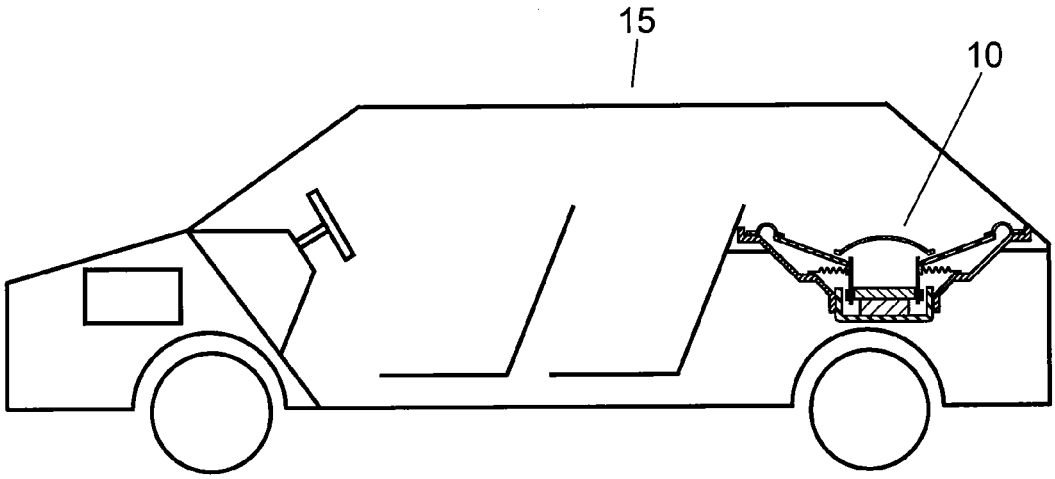
FIG. 5 is a sectional view of a speaker-mounted device according to the fourth exemplary embodiment of the present invention.
Figure 6:
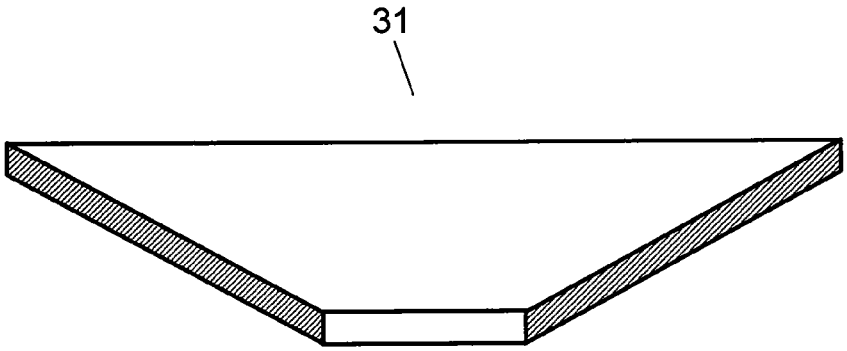
FIG. 6 is a sectional view of a conventional speaker diaphragm.

FIG. 5 is a sectional view of automobile 15, which is a speaker-mounted device according to the fourth exemplary embodiment of the present invention. As shown in FIG. 5, automobile 15 of this embodiment includes automobile body 16. The rear tray and/or front panel of automobile body 16 have speaker 10 incorporated therein to use speaker 10 as part of a car navigation system and/or car audio system. Speaker 10 has the speaker diaphragm described in the first embodiment attached thereto. Hence, the speaker described in the second embodiment can be used as speaker 10. According to this embodiment, speaker 10 provides audio guidance by a car navigation system and music by a car audio system in the automobile.

Consequently, this embodiment allows making characteristics and sound highly accurately with the features of speaker 10 effectively used, and black-based designing with great originality, as described in the first embodiment. Hence, the degree of flexibility in acoustic design can be increased for a speaker-mounted device (e.g. an automobile equipped with this speaker 10)

INDUSTRIAL APPLICABILITY

The present invention is applicable to a speaker diaphragm, speaker, audio visual device, information communications device, and speaker-mounted device (e.g. automobile) that require making characteristics and sound highly accurately, and designing with great originality.

The invention claimed is:

1. Speaker diaphragm fibers comprising resin and carbonized bamboo material.

2. Speaker diaphragm fibers of claim 1, further comprising bamboo fiber.

3. Speaker diaphragm fibers of claim 2, wherein the bamboo fiber further contains the bamboo fiber in a micro fibril state.

4. Speaker diaphragm fibers of claim 1 formed by injection molding.

5. The speaker diaphragm of claim 1, wherein the resin is a crystalline or amorphous olefin resins.

6. Speaker diaphragm fibers of claim 1, wherein the resin is polypropylene.

7. Speaker diaphragm fibers of claim 1, wherein a particle diameter of the carbonized bamboo material is between 30 μm and 100 μm.

8. Speaker diaphragm fibers of claim 1, wherein the carbonized bamboo material is carbonized at 500° C. or higher.

9. Speaker diaphragm fibers of claim 1, wherein a mix ratio of the carbonized bamboo material is between 5% and 20% by weight.

10. Speaker diaphragm fibers of claim 2, wherein a fiber length of the bamboo fiber is between 0.2 mm and 3 mm.

11. Speaker diaphragm fibers of claim 3, wherein an average fiber diameter of the bamboo fiber in a micro fibril state is 10 μm or smaller.

12. Speaker diaphragm fibers of claim 1, wherein the bamboo material is bamboo powder.

13. Speaker diaphragm fibers of claim 1, further comprising a reinforcing material.

14. Speaker diaphragm fibers of claim 13, wherein the reinforcing material contains at least any of mica, talc, calcium carbonate, and clay.

15. Speaker diaphragm fibers of claim 1, further comprising a compatibilizer.

16. A speaker comprising:

a frame combined to a magnetic circuit having a magnetic gap; the speaker diaphragm of claim 1, combined to an outer circumference of the frame; and a voice coil combined with the speaker diaphragm, partially disposed in the magnetic gap of the magnetic circuit.

17. An electronic device comprising:

a speaker including: a frame combined to a magnetic circuit having a magnetic gap; the speaker diaphragm of claim 1, combined to an outer circumference of the frame; and a voice coil combined with the speaker diaphragm, partially disposed in the magnetic gap of the magnetic circuit; and a circuit for amplifying a signal input to the speaker.

18. A speaker-mounted device which is a mobile object having a speaker including: a frame combined to a magnetic circuit having a magnetic gap; the speaker diaphragm of claim 1, combined to an outer circumference of the frame; and a voice coil combined with the speaker diaphragm, partially disposed in the magnetic gap of the magnetic circuit.

* * * * *